US006621998B2

(12) United States Patent
Liu et al.

(10) Patent No.: US 6,621,998 B2
(45) Date of Patent: Sep. 16, 2003

(54) METHOD AND APPARATUS FOR FORMATION AND DEVELOPMENT OF HIGH SOLIDS CONTENT TONER CAKE IN AN ELECTROSTATIC PRINTING SYSTEM

(75) Inventors: Chu-heng Liu, Penfield, NY (US); Weizhong Zhao, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/014,572

(22) Filed: Dec. 14, 2001

(65) Prior Publication Data

US 2003/0113137 A1 Jun. 19, 2003

(51) Int. Cl.[7] ..... G03G 15/10
(52) U.S. Cl. ..... 399/237; 399/239
(58) Field of Search ..... 399/237, 238, 399/239, 246, 247, 302, 308; 430/117, 118, 119

(56) References Cited

U.S. PATENT DOCUMENTS

| | | | | |
|---|---|---|---|---|
| 5,436,706 A | | 7/1995 | Landa et al. | 399/238 |
| 5,619,313 A | | 4/1997 | Domoto et al. | 399/233 |
| 6,122,471 A | | 9/2000 | Liu et al. | 399/237 |
| 6,195,520 B1 | | 2/2001 | Liu et al. | 399/237 |
| 6,219,501 B1 | | 4/2001 | Zhao et al. | 399/57 |
| 6,256,468 B1 | | 7/2001 | Liu | 399/237 |
| 6,289,191 B1 | * | 9/2001 | Liu et al. | 399/223 |
| 6,311,035 B1 | * | 10/2001 | Liu et al. | 399/240 |

FOREIGN PATENT DOCUMENTS

| | | |
|---|---|---|
| EP | 0 935 174 A1 | 8/1999 |
| EP | 1 103 866 A1 | 5/2001 |
| GB | 0 756 213 A1 | 1/1997 |

* cited by examiner

*Primary Examiner*—Hoan Tran

(57) ABSTRACT

An imaging system for effecting electrostatic printing of an image, wherein the imaging system includes an electrostatic printing engine operable in a novel fashion upon a copy substrate, for imaging and development of an electrostatic latent image representative of the image, and subsequently transfers the developed image to the copy substrate. A quantity of low solids content liquid developing material is subject to compression in a process nip such that the concentration of marking particles therein increases and the concentration of carrier fluid decreases. A toner cake layer is thereby formed in the process nip, and is used for development of the electrostatic latent image in a development zone situated in the process nip.

15 Claims, 2 Drawing Sheets

METHOD AND APPARATUS FOR FORMATION AND DEVELOPMENT OF HIGH SOLIDS CONTENT TONER CAKE IN AN ELECTROSTATIC PRINTING SYSTEM

This invention relates generally to electrostatic latent image development systems that operate using liquid developing material, and, more particularly, relates to a system for electrostatic development of a latent image, wherein the latent image is developed with use of a toner cake layer having a high solids content.

A typical electrostatographic printing process includes a development step whereby developing material including toner or marking particles is physically transported into the vicinity of a latent image bearing imaging member, with the toner or marking particles being caused to migrate via electrical attraction to the image areas of the latent image so as to selectively adhere to the imaging member in an image-wise configuration. Various methods of developing a latent image have been described in the art of electrophotographic printing and copying systems. Of particular interest with respect to contact electrostatic printing systems is the concept of forming a thin layer of liquid developing material on a first surface of a first member, wherein the layer has a high concentration of charged marking particles. The layer on the first member is brought into contact with an electrostatic latent image on a second surface of a second member, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields.

Exemplary patents which may describe certain aspects of electrostatic and electrostatographic printing, as well as specific apparatus therefor, may be found in U.S. Pat. Nos. 4,504,138; 5,436,706; 5,596,396; 5,610,694; and 5,619,313, the disclosures of which are incorporated herein by reference.

It is desirable that the aforementioned layer of liquid developing material be provided in a very thin and very uniform layer that exhibits a high proportion of solids, that is, having a high solids content. Even more desirable is such a layer exhibiting the following advantageous characteristics: a selectable, uniform thickness, preferably in the range of 3–10 microns; a high solids content, preferably in the range of 15 to 35 percent solids; and an uniformly metered mass per unit area on the order of 0.1 mg per $cm^2$.

The intuitive and conventional approach is to attempt the formation of such a layer by direct application of liquid developing material having a high solids content. However, due to the very complicated rheological behavior of a liquid developing material having the requisite high solids content, such direct application of a supply of such liquid developing material to a receiving member typically does not achieve a layer having the aforementioned desirable characteristics. For example, the resulting layer has been found to exhibit a variable thickness and a non-uniform mass per unit area, which renders the layer generally unsuitable for most electrostatic printing applications.

In accordance with one aspect of the present invention, there is provided an imaging system for effecting electrostatic printing of an image, wherein the imaging system includes at least one electrostatic printing engine operable in a novel fashion, wherein the electrostatic printing engine images and develops an electrostatic latent image representative of the image, and subsequently transfers the developed image to the copy substrate.

In accordance with another aspect of the present invention, a toner cake formation apparatus may be constructed and operated in accordance with the electrostatic printing process to which the present invention is directed, wherein a thin, uniform toner cake layer of high solids content is formed in a process nip between first and second movable members. The toner cake layer is generally characterized as having a high solids content (e.g., approximately 10–50 percent solids, and preferably in the range of approximately 15 to 35 percent solids, or greater), and exhibits the additional advantageous characteristics of a uniform thickness, in the range of 1–15 microns, and an uniformly metered mass per unit area in the range of 0.03–0.2 mg per $cm^2$.

In accordance with another aspect of the present invention, an imaging system for effecting electrostatic printing of an output image may be constructed, wherein a first movable member is provided in the form of an imaging member having a latent electrostatic image on an image bearing surface, and the second movable member is provided in the form of a developed image receiving member. A toner cake layer of high solids content is formed in a process nip between the first and second movable members. A developed image is created as the toner cake layer exits the process nip, wherein portions of the toner cake layer separate in correspondence with the image and non-image regions of the latent image.

A preferred embodiment of the imaging system includes a supply of low solids content liquid developing material from which a low solids content liquid developing material applicator establishes a relatively uniform and constant aggregation of low solids content liquid developing material at the entrance of the process nip. The low solids content liquid developing material is a mixture of marking particles, such as toner particles, dispersed in a fluid carrier medium. This aggregation of low solids content liquid developing material is subject to compression in the process nip, such that the concentration of marking particles is increased in the process nip, and the concentration of carrier liquid is decreased in the process nip, thus causing formation of the desired toner cake layer.

In another aspect of the invention, a pre-development zone is established at the entrance of the process nip, wherein a controllable proportion of toner particles are believed to be preferentially capable of sustaining compression at the nip entrance so as to pass into the process nip. In contrast, a controllable proportion of the carrier fluid is believed to be preferentially restrained from entering the process nip. The increase in concentration of toner particles in the process nip thus yields a toner cake layer that is continuously formed therein.

In another aspect of the invention, the formation of the toner cake layer is accompanied by concurrent or near-concurrent development of the electrostatic latent image in a development zone situated in the process nip. The onset of formation of the toner cake layer is believed to occur during the forced migration of toner particles into the process nip. Complete formation of the toner cake layer is believed to occur concurrently or prior to the development of the latent image within the process nip, such that the developed image is completed upon separation of the toner cake layer into image and non-image portions at the process nip exit.

In accordance with another aspect of the present invention, an embodiment of a novel electrostatic printing engine may be constructed for imaging and development of a latent image, wherein the electrostatic printing engine includes an imaging member which is rotated so as to transport the surface thereof in a process direction for implementing steps for charging and formation of an electrostatic image corresponding to the desired latent image. A second movable member, in the form of a developed image receiving member, is provided in combination with an applicator of low solids content liquid developing material. The applicator establishes an aggregation of low solids content liquid developing material at the entrance of a process nip between the first and second movable members. Preferably, the aggregation is generally made up of toner particles immersed in a liquid carrier material and also typically including a charge director for providing a mechanism for producing an electrochemical reaction in the liquid developing material composition which generates the desired electrical charge on the toner particles. Movement of the imaging member and the developed image receiving member causes the toner cake layer to be formed in the process nip. As portions of the toner cake layer, which are subject to the electrostatic forces from the latent image, exit the process nip, a developed image, made up of selectively separated portions of the toner cake layer, is provided. Transfer of the developed image may then be accomplished.

The developed image may be provided on the imaging member, or, in a preferred embodiment, the developed image may be provided on the developed image receiving member. Accordingly, in the latter apparatus, a transfer station employing for high-temperature and pressure transfer and/or transfixing may be advantageously employed for carrying out the image transfer step from the developed image receiving member.

Accordingly, a preferred embodiment of an electrostatic printing engine may be constructed to include a movable photosensitive imaging member for receiving an electrostatic latent image. The imaging member includes a photosensitive surface capable of supporting a latent image, from which portions of the aforementioned toner cake layer are separated for subsequent transfer to a copy substrate. An imagewise exposure device is provided for generating the electrostatic latent image on the imaging member, wherein the electrostatic latent image includes image areas defined by a first charge voltage and non-image areas defined by a second charge voltage distinguishable from the first charge voltage. The apparatus is operated for forming the toner cake layer in the process nip between the surface of the imaging member and an adjacent receiving surface on a image receiving member. In response to the electrostatic latent image, developed non-image areas corresponding to the electrostatic latent image are provided on the imaging member, and developed image areas are provided on the receiving surface. Continued movement of the imaging member and the image receiving member causes separation of the toner cake layer in an image-wise manner. The developed image areas are then available for transfer to a copy substrate, and non-image (background) areas are removed from the imaging member.

In another aspect of the present invention, imagewise electric fields across the layer of toner cake are generated in the process nip. The process nip is defined by a nip entrance and a nip exit, wherein the process nip and the nip entrance are operative to apply compressive stress forces on the quantity of low solids content liquid developing material present therein, and the nip exit is operative to apply tensile stress forces to the toner cake layer, causing imagewise separation of the layer of toner cake in a pattern corresponding to the electrostatic latent image. The layer of toner cake is defined by a yield stress threshold in a range sufficient to allow the layer of toner cake to behave substantially as a solid at a development zone located between the nip entrance and the nip exit, while allowing the layer of toner cake along the boundary of the latent image and the image background to behave substantially as a liquid at the nip exit.

The toner cake layer is exposed to at least two stresses: a compressive stress in the process nip as well as at the entrance thereof; and a tensile stress at the nip exit as the developed image is separated into image areas on one surface and background areas on the other surface. In order to optimize the resultant image quality, it is desirable that the toner cake layer have sufficient yield stress to allow the toner particles therein to maintain their integrity while being exposed to these particular stress forces. Thus, pre-selecting materials having a particular yield stress and selectively controlling the compression forces applied to the aggregation of low solids content liquid developing material can assist in providing a self-sustaining process for formation of a toner cake layer having advantageous characteristics such as controlled thickness and density. These characteristics can be particularly useful in defining operational parameters for optimization of the electrostatic printing process.

Additionally, the electrostatic printing process of the present invention includes limited relative movement between toner particles during and after latent image development, wherein the high solids content of the toner cake layer prevents toner particles from moving relative to each other.

The foregoing and other aspects of the present invention will become apparent from the following description in conjunction with the accompanying drawings, wherein like reference numerals have been used throughout to identify identical or similar elements.

The present invention is directed to an electrostatic imaging system wherein latent image development is carried out via segmentation of a toner cake layer and which in particular utilizes image-wise electrostatic forces to separate the layer of toner cake into image and non-image regions. Although the following description will describe, by example, several embodiments of an electrostatic printing engine, and related processes that incorporate a photosensitive imaging member, it will be understood that the present invention contemplates the use of various alternative imaging members as are well known in the art of electrostatographic printing, including, for example, but not limited to, non-photosensitive imaging members such as a dielectric charge retaining member of the type used in ionographic printing machines, or electroded substructures capable of generating charged latent images.

Figure 1:
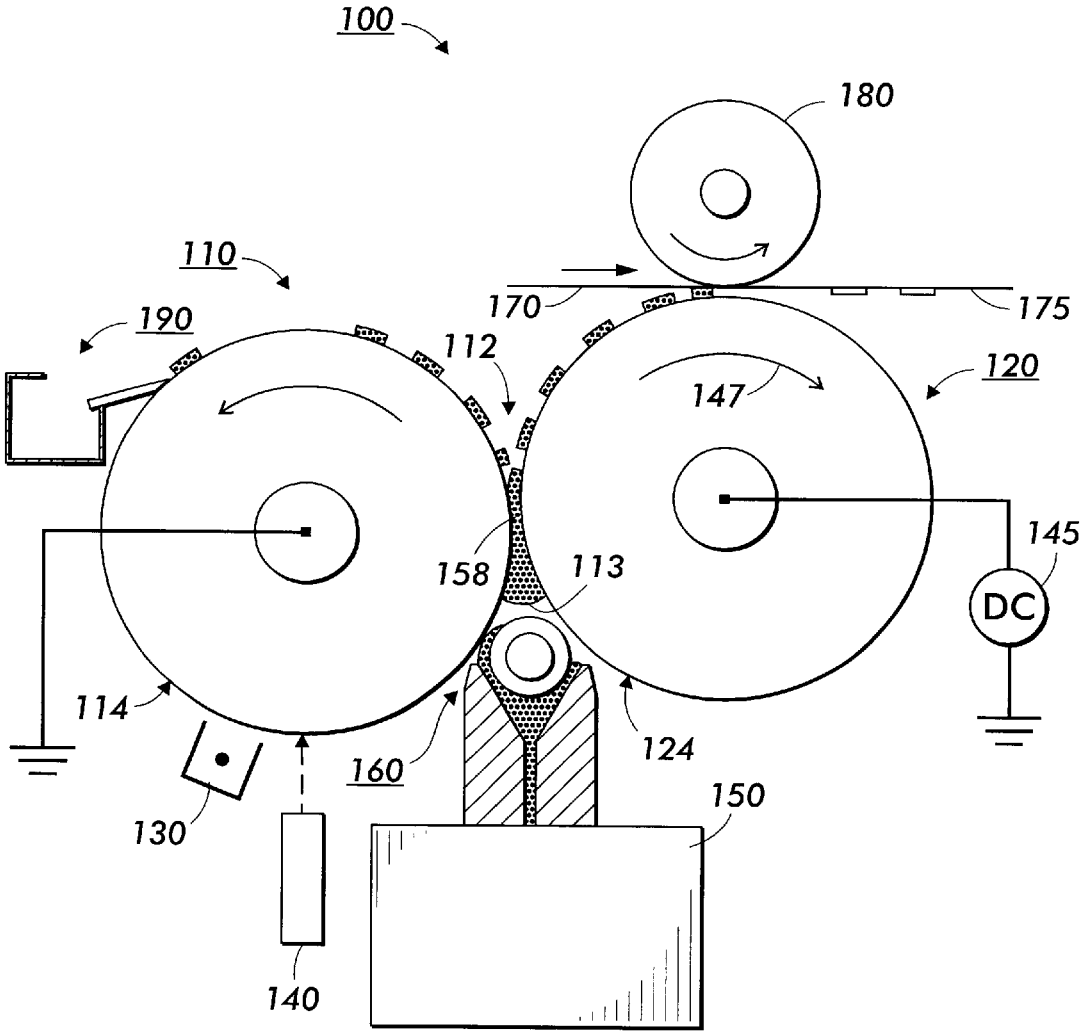
FIG. 1 is a simplified elevational view schematically depicting an embodiment of an electrostatic printing engine constructed for imaging and development of an electrostatic latent image, wherein a layer of highly concentrated toner cake is formed in a process nip.

FIG. 1 is a simplified schematic representation of an apparatus constructed according to the present invention for use in an electrostatographic imaging system, such as an electrostatic printing system. The electrostatic printing engine may be employed for imaging and developing a electrostatic latent image that corresponds to a desired image. A layer of toner cake is formed in a process nip for use in development of the latent image, with separation and subsequent transfer of the developed image onto a copy substrate, thereby providing an output image on the copy substrate.

FIG. 1 depicts a first embodiment of an electrostatic printing engine 100 constructed for use in imaging and development of an electrostatic latent image. The engine 100 comprises a first movable member in the form of an imaging member 110 including a image bearing surface 114 of any type capable of having an electrostatic latent image formed thereon. An exemplary imaging member 110 may include a typical photoconductor or other photoreceptive component of the type known to those of skill in the art of electrophotography, wherein a surface layer having photoconductive properties is supported on a conductive support substrate. A process nip 112 is maintained between the imaging member 110 and a second movable member provided in the form of a developed image receiving member 120.

The electrostatic printing engine 100 includes a supply 150 of low solids content liquid developing material from which an applicator 160 obtains a sufficient amount of low solids content liquid developing material to establish a relatively uniform and constant aggregation 113 of low solids content liquid developing material at the entrance of the process nip 112. A toner cake layer 158, having a high solids content as described hereinabove, is formed between the image bearing surface 114 of the imaging member 110 and a receiving surface 124 of the developed image receiving member 120.

The applicator 160 may be constructed to apply a layer of low solids content liquid developing material onto the image bearing surface 114 or the receiving surface 124, or directly into the entrance of the process nip 112. A variety of devices or apparatus may be utilized as the applicator 160 for establishing the desired aggregation 113 of low solids content material at the entrance of the process nip 112, such as, but not limited to, known systems directed toward the transportation of liquid developing material having toner particles immersed in a carrier fluid, including various apparatus used in conventional lithographic printing applications as well as traditional liquid electrostatographic applications. For example, the applicator 160 can include a liquid extruder as disclosed in commonly assigned U.S. Pat. No. 5,619,313 (incorporated by reference herein) or a fountain-type device as disclosed generally in commonly assigned U.S. Pat. No. 5,519,473 (incorporated by reference herein). Additionally embodiments of the applicator 160 include the following: a slot die, an extrusion member, a slide, a liquid developing material curtain, a gravure roll, a forward roll, a squeegee roll, a blade apparatus, a foam roller or belt, a wired rod, a screen coater, or a shoe.

The low solids content liquid developing material may be characterized as having a percentage of solids content that is less than the percentage of solids content desired in the toner cake layer 158. For example, an approximately 1–10 percent solids content is considered to be characteristic of a low solids content liquid developing material; an approximately 10–50 percent solids content, or greater, and preferably on the order of approximately 15 to 35 percent solids, is considered to be characteristic of the desired toner cake layer. The toner cake layer also preferably exhibits the additional advantageous characteristics of a uniform thickness, selectable from the range of approximately 1–15 microns, and an accurately metered mass per unit area of approximately 0.1 mg per $cm^2$.

The low solids content liquid developing material is generally made up of toner particles immersed in a liquid carrier material and also typically includes a charge director for providing a mechanism for producing an electrochemical reaction in the liquid developing material composition which generates the desired electrical charge on the toner particles. Generally, the liquid carrier material is present in a large amount in the introductory supply of liquid developing material. The liquid carrier material may be present in an amount of from about 90 to as much as 99.5 percent by weight, although the percentage amount may vary from this range, provided that the objectives of the present invention are achieved.

The low solids content liquid developing material may thus be supplied in a charged state to enhance or control the aggregation of the low solids content liquid developing material. If the low solids content liquid developing material is supplied in a neutral (uncharged) state, suitable means may be employed to charge the material prior to its transformation to the toner cake layer. Chemical charging or corona charging devices, as known in the art, may be utilized.

The electrostatic printing engine 100 is adapted for operation with respect to a copy substrate 175 carried on a substrate transfer path 170. The engine 100 is preferably associated with a respective pressure roller 180 for establishing at least a basic contact transfer, electrostatic transfer, or transfixing of the developed image to the copy substrate 175. An optional fuser assembly (not shown) may be provided for full or final fusing of the developed image when necessary.

Imaging member 110 is rotated so as to transport the receiving surface 124 in a process direction 147 for implementing a series of developed image forming steps. Although the imaging member 110 and the developed image receiving member 120 are each shown and described herein in the form of a drum, these movable members may alternatively be provided in other forms, such as a reciprocating plate or a continuous flexible belt which is entrained over a series of rollers, and is movable in the same direction as shown, with appropriate modification of the illustrated arrangement of components.

Initially, in the exemplary embodiment of FIG. 1, the image bearing surface 114 of imaging member 110 passes through a charging station, which may include a corona generating device 130 or any other charging apparatus for applying an electrostatic charge to the image bearing surface 114 of the imaging member 110. The corona generating device 130 is provided for charging the image bearing surface 114 of imaging member 110 to a relatively high, substantially uniform electrical charge potential. It will be understood that various charging devices, such as charge rollers, charge brushes and the like, as well as inductive and semiconductive charge devices, among other devices which are well known in the art, may be utilized.

After the imaging member 110 is brought to a substantially uniform charge potential, the charged image bearing surface 114 is advanced to an image exposure station, identified generally by reference numeral 140. The image exposure station 140 projects, onto the charged image bearing surface 114, a light image corresponding to the desired latent image. In the case of an imaging system having a photoconductive imaging member 110, the light image projected onto the imaging member 110 selectively dissipates the charge thereon. An electrostatic latent image is recorded on the image bearing surface 114, wherein the electrostatic latent image comprises, in image configuration corresponding to inputted image information, image areas defined by a first charge voltage potential and non-image areas defined by a second charge voltage potential. The image exposure station 140 may incorporate various optical image projection and formation components as are known in the art, and may include various well known light lens apparatus or digital scanning systems for forming and projecting an image from an original input document onto the imaging member 110. Alternatively, various other electronic devices available in the art may be utilized for generating electronic information to create the electrostatic latent image on the imaging member. It will be understood that the electrostatic latent image may be comprised of image and non-image areas that are defined by regions having opposite charge polarities, or by regions having distinguishable first and second voltage potentials which are of the same charge polarity.

Figure 2:
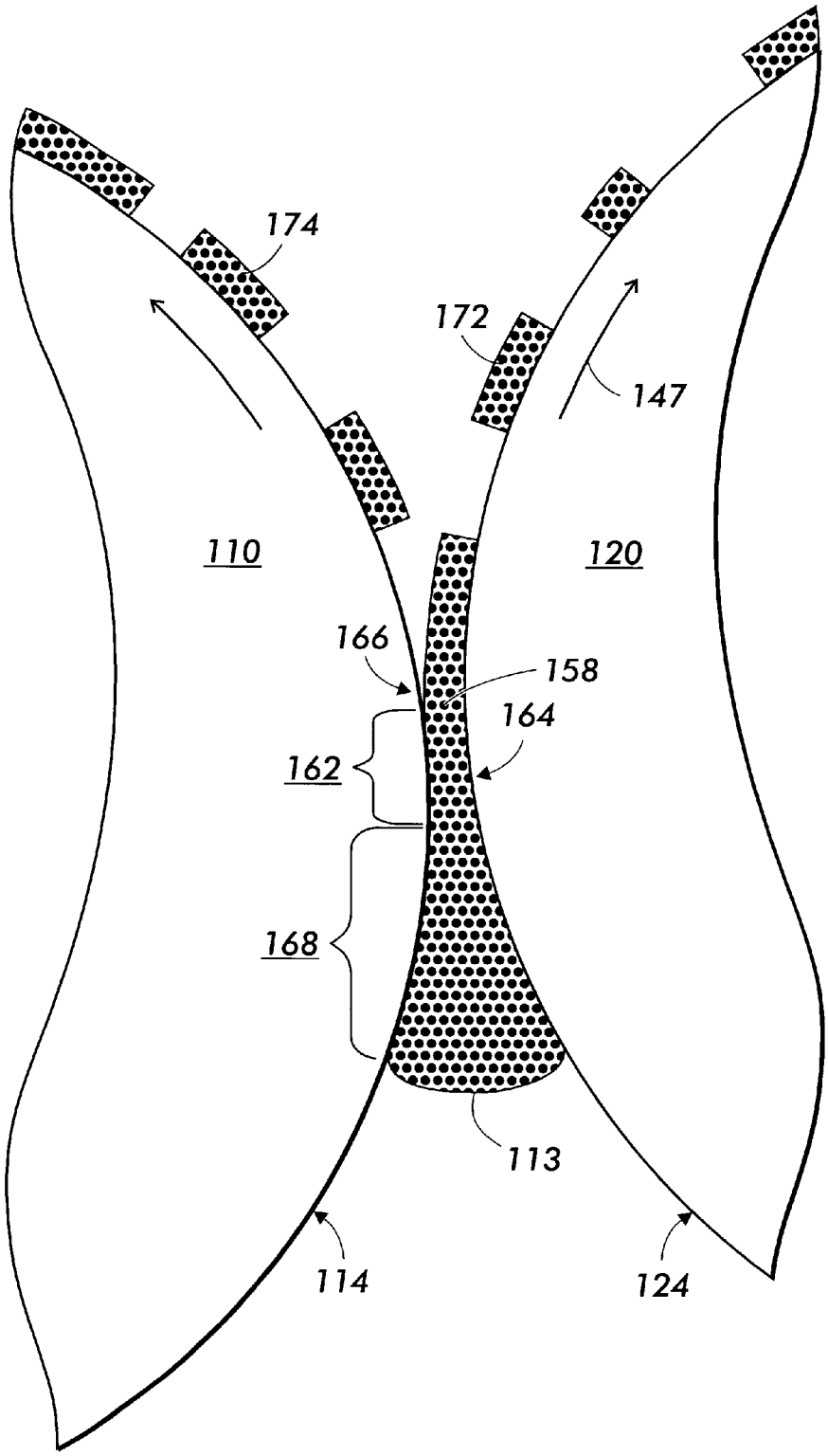
FIG. 2 is an elevational view schematically depicting the process nip effected in the printing engine of FIG. 1.

With additional reference now to FIG. 2, formation of the toner cake layer 158 will be understood. In the pre-nip region, due to the fringe field and the weak electrostatic field formed between the imaging member 110 and the image receiving member 120, the charged toner particles migrate towards one or both surfaces 114 and 124. Due to this electrophoretic motion, the toner concentration in the liquid developing material becomes more concentrated in proximity to the image bearing surface 114 or the receiving surface 124. As a result of this toner migration, some undesired image-like structure may emerge in the toner concentrated portions of the liquid developing material in the pre-nip region 168. However, as the aggregation 113 proceeds to the process nip 112, the liquid developing material is subject to strong compression, shear, and smearing at the nip entrance 164 and any undesired image-like structure is significantly reduced, due to the smoothing action of the liquid flow. As a result, a uniform layer of concentrated toner coalesces in the process nip 112. This layer of concentrated toner is capable of sustaining a significant compression stress so as to enter and pass through the process nip 112, thus forming the desired toner cake layer 158, whereas the dilute portion of the liquid developing material is squeezed away from the process nip 112.

Accordingly, and depending on the materials utilized in the liquid developing material composition, as well as other process parameters related to the printing system, such as nip pressure, process speed and the like, the toner cake layer 158, having sufficient thickness, preferably between 2 and 15 microns and more preferably on the order of 5 microns or less, is formed in the process nip 112 due to the proximity and/or contact pressure between the imaging member 110 and the developed image receiving member 120. Suitable contact pressures are believed to those be sufficient to allow passage of a controlled ratio, or proportion, of the concentration of the toner particles entering the process nip 112 with respect to the concentration of the carrier fluid entering the process nip 112. Suitable contact pressures are contemplated to be in the range of 1–10 pounds per square inch.

Accordingly, one aspect of the engine 100 illustrated in FIG. 2 is to subject a portion of the aggregation 113 to compression according to its proximity to, and within, the process nip 112. It may desirable to provide either the surface of the developed image receiving member 120 or the image bearing surface 114 of the imaging member 110 in the form of a conformable surface for permitting one of such members to correspond in form or character to the surface of the opposing member in the process nip 112.

Upon formation in the process nip 112, the toner cake layer 158 is substantially uniformly distributed within the gap created between the two members such that toner particle motion and/or liquid flow is negligible with no distortion being present or induced between the toner particles in the toner cake layer 158. The toner cake layer 158 thus attains a solid-like property in the process nip 112.

It will be understood that the presence of the latent image on the imaging member 110 may generate some fringe fields in the interface between image and non-image areas of the latent image. However, compared to conventional development, the present invention will substantially eliminate fringe-field-related image defects due to the solid-like property of the toner cake layer 158.

An electrical biasing source 145 is coupled to the developed image receiving member 120 for applying an electrical bias thereto so as to generate electrostatic fields between the receiving surface 124 of the developed image receiving member 120 and the image or non-image areas on the surface 114 of the imaging member 110. These electrostatic fields generate fields in opposite directions, either toward the surface of the imaging member 110 or towards the surface of the developed image receiving member 120 in accordance with image and non-image portions of the latent image. As illustrated in FIG. 2, the developed image receiving member 120 is provided with an electrical bias appropriate for attracting image areas while repelling non-image areas toward the imaging member 110, thereby maintaining toner portions corresponding to image areas on the surface of the developed image receiving member 120, yielding a developed image on the developed image receiving member 120.

With separation of the surfaces 114, 124 at the process nip exit 166, the electrostatic fields cause the separation of the image and non-image areas of the toner cake layer 158, thus simultaneously separating and developing the toner cake layer 158 into image and non-image portions. Development occurs with substantially reduced movement of the toner particles. The development can therefore be implemented at an increased rate to allow high speed processing and improved throughput rates.

The thickness of the toner cake layer 158 in the process nip 112 is largely determined according to the process nip gap maintained between the imaging member 110 and the developed image receiving member 120. Preferably the process nip gap is less than 15 microns and more preferably less than 5 microns. The toner cake layer 158 can have a thickness of about 1 micron and still produce acceptable print quality. A process nip gap of less than 5 microns is believed to enable development of images of greater than 800 dots per inch (dpi).

Formation of the toner cake layer 158 occurs according to at least two very different and opposed stress forces. As the aggregate 113 is established in a predevelopment zone 168, toner particles are forced into the process nip 112 and are subject to compressive stress forces, causing formation of the toner cake layer 158 in a development zone 162 located within the process nip 112. Almost immediately, as the toner cake layer passes the process nip exit 166, the toner cake layer 158 is separated into image areas 172 and background areas 174 as tensile stress forces are generated and exerted upon the toner cake layer 158.

Image quality is at least partly dependent on the ability of the toner cake layer 158, and in particular, the toner particles therein, to maintain their integrity as an assemblage of toner particles such that lateral movement of the toner particles is prevented when at the nip exit 166, the image areas 172 will stay with one surface and the non-image areas 174 will stay with another surface according to the image-wise electrical field. In addition, image quality is partly dependent on the ability of the toner particles in the toner cake layer 158 to divide sharply along the image-background boundary where the electrostatic force is substantially zero. The clean breaking of the edge to edge provides for improved edge definition of the developed image relative to prior development systems. Thus, it is desired for the toner cake layer 158 to attain a shear tensile yield stress which is substantially lower than the stress induced by the electric fields at the exit of the nip 112, for preventing image quality degradation when the toner cake layer is exposed to tensile stress forces at the nip exit while separating into image and non-image regions on opposed surfaces.

The non-image areas 174 and image areas 172 are interspersed due to each extending from the respective surfaces of the imaging member 110 and developed image receiving member 120 more than one half of the gap of the process nip 112. The thickness of the toner layers of the non-image and the image areas are therefore typically greater than one half the gap of the process nip 112.

As illustrated in FIGS. 1 and 2, with the developed image and background being separated at the exit 166 of the process nip 112, continued rotation of developed image receiving member 120 allows the image areas 172 to be transferred from the receiving surface 124 onto a copy substrate 175 that is carried on the substrate transfer path 170.

In the illustrated embodiment, a copy substrate 175 such as a paper sheet may be aligned on the substrate path 170 to receive such a transfer. Developed image transfer may be effected via selectable means known in the art, and in some embodiments may be effected in accordance with the registration requirements of a composite color image, such as an electrostatic transfer apparatus including a corona generating device or a biased transfer roll. In yet another alternative, image transfer can be accomplished via surface energy differentials wherein the surface energy between the image and the member supporting the image prior to transfer is lower than the surface energy between the image and the copy substrate, inducing transfer thereto.

A pressure transfer roll system may be employed to tack the developed image to the copy substrate 175; this system may include a heating and/or chemical application device for assisting in the pressure transfer and fixing of the developed image on the copy substrate 175. In the embodiment shown in FIG. 1, the developed image may be transferred to a copy substrate 175 via a heated pressure roll 180, whereby pressure and heat are simultaneously applied to the developed image to simultaneously transfer and at least partially fuse (e.g., transfuse) the developed image to the copy substrate 175.

Alternatively, the developed image receiving member 120 may be biased so as to repel image areas, thereby producing a developed image made up of selectively separated and transferred portions of the toner cake layer 158 on the surface of the imaging member 110, while leaving background image byproducts on the surface of the developed image receiving member 120. In such an alternative embodiment, the illustrated arrangement of the pressure roller 180 would be omitted and a suitable transfer station would be located to receive transfer of the developed image from the imaging member 110 to a copy substrate 175.

In a final step, the non-image areas are removed in preparation for a subsequent imaging cycle. FIG. 1 illustrates a simple blade cleaning apparatus 190 as is known in the art. Alternative embodiments may include a brush or roller member for removing toner from the surface on which it resides. The removed toner may be transported to a toner sump or other conservation vessel so that the waste toner can be recycled and used again to generate another toner cake layer 158 in subsequent imaging cycles.

It will be understood that the illustrated embodiment may include ancillary apparatus, such as a carrier fluid collector (not shown) situated in close proximity to the aggregation 113, for collection of excess carrier fluid which eventually accumulates at the meniscus of the aggregation 113 and may be withdrawn and returned to the supply 150 for reuse.

The toner cake layer 158 achieves high enough yield stress to substantially eliminate lateral movement of the toner particles in the toner cake layer 158 when exposed to compression stresses generated in the nip 112, while also having sufficiently low yield stress to permit the toner layer to act as a liquid in the presence of tensile stress forces present in the vicinity of the nip exit. Further definition of operational parameters for such optimization of the electrostatic printing process, via pre-selecting materials having a particular yield stress and/or selectively varying the yield stress of a given liquid developing material, may be determined by those skilled in the art so as to pre-select the materials making up the liquid developing material, the toner particle concentration of the liquid developing material, and the electrical field strength generated between the image receiving surface 124 and the electrostatic latent image on the image bearing surface 114.

The toner particles or so-called marking particles are selectable as known in the art, e.g., cyan, magenta, yellow, and black; however, other component colors may be employed. Furthermore, the low solids content liquid developing material operable in the engine 100 may be distinguishable according to one or more physical characteristics in addition to, or other than, the color of the marking material, and nonetheless such engines are encompassed by the present invention.

The marking particles can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the toner particles should have an average particle diameter ranging from about 0.2 to about 10 microns, and most preferably between about 0.5 and about 2 microns. The toner particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E.I. DuPont de Nemours & Co. of Wilmington, Delaware. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

The carrier fluid medium utilized in the low solids content developing material may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasole, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

As previously indicated, in addition to the liquid carrier vehicle and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

What is claimed is:

1. A toner cake layer formation apparatus for creation of a toner cake layer having a high solids content, the apparatus being operable in an electrostatic printing engine, comprising:

a supply of liquid developing material, the liquid developing material being a mixture of marking particles in a liquid carrier medium, the mixture exhibiting a percentage level of solids content that is less than the percentage level of solids content in the desired toner cake layer;

a liquid developing material applicator connected to the supply of liquid developing material and operable for receiving a quantity of liquid developing material and for providing therefrom an aggregation of liquid developing material;

first and second movable members aligned with the liquid developing material applicator, the first movable member having a respective first member surface and the second movable member having a respective second member surface, the first member surface and second member surface defining a process nip having a process nip entrance and a process nip exit, the process nip entrance being located with respect to the applicator so as to receive therein the aggregation of liquid developing material, and the first and second members being movable for: (1) transporting, into the process nip entrance, a controlled amount of the liquid developing material present in the aggregation, (2) subjecting the controlled amount of liquid developing material to compression to increase the percentage level of solids content in the liquid developing material amount present in the process nip, whereby the controlled amount of liquid developing material is transformed into the desired toner cake layer, and (3) delivering the toner cake layer to the nip exit.

2. The apparatus of claim 1, wherein the low solids content liquid developing material is characterized as having percentage level of solids content in the range of approximately 1 to 10 percent solids content.

3. The apparatus of claim 1, wherein the toner cake layer is characterized as having at least one of the following characteristics: a percentage level of solids content of approximately 10 percent solids content or greater, a uniform thickness in the range of 1 to 15 microns, and a uniformly metered mass per unit area in the range of approximately 0.03 to 0.2 mg per $cm^2$.

4. The apparatus of claim 1, wherein a contact pressure between the first member surface and second member surface is provided in the range of 1–10 pounds per square inch.

5. The apparatus of claim 1, wherein the applicator is operable to form the aggregation by direct application of a layer of liquid developing material to at least one of the first member surface and the second member surface.

6. The apparatus of claim 1, wherein the applicator is operable to form the aggregation by direct application of a quantity of liquid developing material to the nip entrance.

7. An imaging system for effecting electrostatic printing of an output image, comprising:

an imaging assembly having a first movable member provided in the form of an imaging member, the imaging member having an image bearing surface for receiving an electrostatic latent image thereon, the latent image being representative of the desired output image, a second movable member provided in the form of a developed image receiving member having a receiving surface for receiving a developed image;

a supply of liquid developing material, the liquid developing material being a mixture of marking particles in a liquid carrier medium, the mixture exhibiting a percentage level of solids content that is less than the percentage level of solids content in a desired toner cake layer;

a liquid developing material applicator connected to the supply of liquid developing material and operable for receiving a quantity of liquid developing material and for providing therefrom an aggregation of liquid developing material;

wherein the first and second movable members are aligned with the liquid developing material applicator, and the image bearing surface and the developed image receiving surface define a process nip having a process nip entrance and a process nip exit, the process nip entrance being located with respect to the applicator so as to receive therein the aggregation of liquid developing material, and wherein the first and second movable members are movable for: (1) transporting, into the process nip entrance, a controlled amount of the liquid developing material present In the aggregation, (2) subjecting the controlled amount of liquid developing material to a compressive force to increase the percentage level of solids content in the liquid developing material amount present in the process nip, whereby the controlled amount of liquid developing material is transformed into the desired toner cake layer, (3) subjecting the toner cake layer to imagewise electric fields across the toner cake layer in the process nip, and (4) delivering the toner cake layer to the nip exit, whereupon the toner cake layer undergoes imagewise separation to create a developed image corresponding to the electrostatic latent image and a background image; and a transfer assembly for transfer of the developed image to a copy substrate, to create the output image.

8. The imaging system of claim 7, further comprising an electrostatic latent image including image areas defined by a first voltage potential and non-image areas defined by a second voltage potential.

9. The imaging system of claim 7, wherein the process nip further comprises a pre-established nip gap, wherein the developed image and the background image each exhibit a thickness of greater than one half the nip gap.

10. The imaging system of claim 7 wherein the toner cake layer is defined by a yield stress threshold in a range sufficient to allow the toner cake layer to behave substantially as a solid in the nip gap, while allowing the toner cake layer to behave substantially as a liquid along the boundaries of image areas and non-image areas at the nip exit.

11. The imaging system of claim 7, wherein the image bearing surface includes a photosensitive imaging substrate.

12. The imaging system of claim 7, wherein the low solids content liquid developing material is characterized as having percentage level of solids content in the range of approximately 1 to 10 percent solids content.

13. The imaging system of claim 7, wherein the toner cake layer is characterized as having at least one of the following characteristics: a percentage level of solids content of approximately 10 percent solids content or greater, a uniform thickness in the range of 1 to 15 microns, and a uniformly metered mass per unit area in the range of approximately 0.03 to 0.2 mg per $cm^2$.

14. A method for creation of a toner cake layer having a high solids content in an electrostatic printing engine, comprising:

providing a supply of liquid developing material, the liquid developing material being a mixture of marking particles in a liquid carrier medium, the mixture exhibiting a percentage level of solids content that is less than the percentage level of solids content in the desired toner cake layer;

receiving a quantity of liquid developing material and for providing therefrom an aggregation of liquid developing material;

aligning first and second movable members with the aggregation of liquid developing material, the first movable member having a respective first member surface and the second movable member having a respective second member surface the first member surface and second member surface defining a process nip having a process nip entrance and a process nip exit, the process nip entrance being located with respect to the applicator so as to receive therein the aggregation of liquid developing material;

moving the first and second movable members for: (1) transporting, into the process nip entrance, a controlled amount of the liquid developing material present in the aggregation, (2) subjecting the controlled amount of liquid developing material to compression to increase the percentage level of solids content in the controlled amount of liquid developing material present in the process nip, whereby the controlled amount of liquid developing material is transformed into the desired toner cake layer, and (3) delivering the toner cake layer to the nip exit.

15. A method for effecting electrostatic printing of an output image, comprising:

providing a first movable member in the form of an imaging member, the imaging member having an image bearing surface for receiving an electrostatic latent image thereon, the latent image being representative of the desired output image;

providing a second movable member in the form of a developed image receiving member having a receiving surface for receiving a developed image;

providing a supply of liquid developing material, the liquid developing material being a mixture of marking particles in a liquid carrier medium, the mixture exhibiting a percentage level of solids content that is less than the percentage level of solids content in a desired toner cake layer;

aligning the first and second movable members whereby the image bearing surface and the developed image receiving surface define a process nip having a process nip entrance and a process nip exit, receiving an aggregation of the liquid developing material at the process nip entrance;

moving the first and second movable members for (1) transporting, into the process nip, a controlled amount of the liquid developing material present in the aggregation, (2) subjecting the controlled amount of liquid developing material to a compressive force to increase the percentage level of solids content in the liquid developing material amount present in the process nip, whereby the controlled amount of liquid developing material is transformed into the desired toner cake layer, (3) subjecting the toner cake layer to imagewise electric fields across the toner cake layer in the process nip, and (4) and delivering the toner cake layer to the nip exit, whereupon the toner cake layer undergoes imagewise separation to create a developed image corresponding to the electrostatic latent image; and transferring the developed image to a copy substrate to create the output image.

* * * * *